US006360720B1

(12) United States Patent
Kesler

(10) Patent No.: US 6,360,720 B1
(45) Date of Patent: Mar. 26, 2002

(54) HIGH TEMPERATURE COMPENSATION CIRCUITRY FOR AN IGNITION CONTROL CIRCUIT

(75) Inventor: Scott B. Kesler, Kokomo, IN (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 09/624,880

(22) Filed: Jul. 24, 2000

(51) Int. Cl.[7] ..... F02P 5/00
(52) U.S. Cl. ..... 123/406.55; 123/630; 123/644
(58) Field of Search ..... 123/630, 406.55, 123/644, 654, 655

(56) References Cited

U.S. PATENT DOCUMENTS

| | | | | |
|---|---|---|---|---|
| 4,446,843 A | * | 5/1984 | Rumbaugh et al. | 123/609 |
| 5,197,430 A | * | 3/1993 | Hoshiba et al. | 123/421 |
| 5,611,318 A | * | 3/1997 | Kesler | 123/630 |
| 5,819,713 A | | 10/1998 | Kelser | 123/630 |
| 6,186,130 B1 | * | 2/2001 | Skinner et al. | 123/625 |

* cited by examiner

*Primary Examiner*—Henry C Yuen
*Assistant Examiner*—Mahmoud Gimie
(74) *Attorney, Agent, or Firm*—Jimmy L. Funke

(57) ABSTRACT

A temperature dependent current generating circuit includes a circuitry for producing a first voltage that is substantially constant over temperature, circuitry for producing a second voltage that increases with increasing temperature, wherein the second voltage intersects the first voltage at a predefined temperature, and a comparator circuit receiving the first and second voltages. The comparator circuit is responsive to the first and second voltages to source a compensation current below the predefined temperature; i.e., when the second voltage is below the first voltage, and to sink the compensation current above the predefined temperature; i.e., when the second voltage is above the first voltage. A current generating circuit is operable to divert the compensation current away therefrom at temperatures below the predefined temperature and to produce a charging current at such temperatures only as a function of a base charging current, and to draw the compensation current away from the base charging current at temperatures above the predefined temperature so that the charging current is a decreasing function of temperature at such temperatures.

20 Claims, 4 Drawing Sheets

HIGH TEMPERATURE COMPENSATION CIRCUITRY FOR AN IGNITION CONTROL CIRCUIT

TECHNICAL FIELD

The present invention relates generally to circuitry for controlling automotive ignition systems, and more specifically to circuitry for compensating for undesirable high temperature operating effects associated with such systems.

BACKGROUND OF THE INVENTION

Modern inductive-type automotive ignition systems typically control the ignition coil such that coil current is allowed to increase to a level high enough to guarantee sufficient spark energy for properly igniting an air/fuel mixture. The inductive nature of an ignition coil dictates that the coil current will increase over time, wherein a control circuit is typically operable to terminate coil charging after a so-called "dwell time" and thereby initiate a spark event, or to dynamically maintain the coil current at a predefined current level for a predefined time period before initiating a spark event.

In either case, ignition control circuits typically include a protection feature operable to prevent damage to the ignition controller circuitry or to the ignition coil itself in the event of a fault that could cause the coil to remain in a conductive state for prolonged periods of time. Such a protection feature is commonly implemented by a simple timing function that shuts off the drive signal to the coil current switching device after a predetermined time period has elapsed since activation thereof.

This "over-dwell" protection time must be guaranteed to be longer than the longest expected dwell period required by the ignition system for proper charging of the ignition coil. If the over-dwell protection period is too short, there may be insufficient energy in the ignition coil to ignite the air-fuel mixture, or the engine spark timing may be compromised in a fashion that creates emission problems. On the other hand, if the over-dwell protection period is too long, the ignition coil and/or controlling electronics may over heat and consequently become damaged. In either case, the protection circuitry has failed at its primary purpose.

Due to the relatively long over-dwell protection times required for engines operating in very low RPM or "crank" modes; e.g., several tens of milliseconds, the over-dwell protection circuit may require a capacitor external to the integrated ignition control circuit. One known example of an ignition system 10 of the type just described is illustrated in FIG. 1, wherein system 10 includes an ignition control circuit 14 receiving an electronic spark timing (ES) signal from a control circuit 12 such as a microprocessor or microprocessor-based control circuit. The ignition control circuit 12 is responsive to the EST signal to supply a gate drive signal GD to a gate 16 of at least one insulated gate bipolar (IGBT) transistor 18 or other coil switching device. A collector 20 of IGBT 18 is connected to one end of a primary coil 32 forming part of an automotive ignition coil 30 having an opposite end connected to battery voltage VBATT. The primary coil 30 is coupled to a secondary coil 34 having opposite terminals connected to opposing electrodes of an ignition plug 36 defining a spark gap therebetween. An emitter 22 of IGBT 18 is connected to one end of a sense resistor Rs having an opposite end connected to ground potential, and to circuit 14. System 10 may include additional IGBT and ignition coil pairs, as is known in the art, and circuit 14 is also connected to an external capacitor CEXT referenced at ground potential.

In the operation of system 10, the ignition control circuit 14 is responsive to a rising edge of an EST signal to supply a full gate drive signal GD to the gate 16 of IGBT 18. As IGBT 16 begins to conduct in response to the gate drive signal GD, a coil current Ic begins to flow through primary coil 32, through IGBT 18 and through Rs to ground, thereby establishing a "sense voltage" Vs across resistor Rs. As the coil current Ic increases due to the inductive nature of coil primary 32, the sense voltage Vs across Rs likewise increases until it reaches an internal voltage VREF. At this point, the ignition control circuit 14 causes the gate drive circuit 20 to turn off or deactivate the gate drive voltage GD so as to inhibit the flow of coil current Ic through the primary coil 32 and coil current switching device 18. This interruption in the flow of coil current Ic through primary coil 32 causes primary coil 32 to induce a current in the secondary coil 34, wherein the secondary coil 34 is responsive to this induced current to generate an arc across the electrodes of the ignition plug 36. The ignition control circuit 14 further includes over-dwell protection circuitry operable to selectively charge and discharge capacitor CEXT at a rate defined by the EST signal. If EST remains in an active state for an excessive, or over-dwell time period, the charge on CEXT reaches a level that causes the ignition control circuit to gradually deactivate IGBT 18 to thereby gradually decrease the coil current Ic so as not to generate a spark event. Further details relating to the structure and operation of one known ignition control circuit of the foregoing type are provided in U.S. Pat. No. 5,819,713 to Kesler, which is assigned to the assignee of the present invention, and the contents of which are incorporated herein by reference.

A common type of capacitor implemented as CEXT in the system 10 illustrated in FIG. 1; i.e., one that is available in "chip" form with desirable values and voltage ratings, uses a dielectric of the type known in the art as "X7R." While such capacitors provide desirable parametric behavior at relatively low cost, however, they have the undesirable characteristic of a significant fall-off in capacitance at high temperatures. Referring to FIG. 2, for example, a waveform 40 of % capacitance variation over temperature is illustrated for a known and commonly used X7R capacitor having a room temperature (e.g., 25 degrees C) value of 0.22 microfarads. Waveform 40 exhibits a slightly rounded characteristic from approximately −40 degrees C to approximately 60 degrees C, and exhibits a steep roll-off in capacitance starting at approximately 125 degrees C. An over-dwell protection circuit of the type described hereinabove that utilizes a capacitor of the type illustrated in FIG. 2 would accordingly exhibit an increasingly significant reduction in the over-dwell protection time as temperature increases beyond 125 degrees C.

What is therefore needed is a capacitor charging circuit operable to charge capacitor CEXT with a current that compensates for undesirable temperature characteristics of CEXT to thereby minimize timing errors at any given temperature.

SUMMARY OF THE INVENTION

The foregoing shortcomings of the prior art are addressed by the present invention. In accordance with one aspect of the present invention a temperature dependent current generating circuit comprises a first circuit producing a first voltage that is substantially constant over a range of temperatures, a second circuit producing a second voltage as an increasing function of temperature over the range of temperatures, a third current producing a charging current, and a comparator circuit responsive to the first and second voltages to draw a compensation current away from the charging current when the second voltage increases with temperature above the first voltage, wherein the compensation current increases with increasing temperature over the range of temperatures.

In accordance with another aspect of the present invention, a temperature dependent current generating circuit comprises a first circuit producing a compensation current as a function of temperature, and a second circuit producing a charging current, wherein the charging current is a function only of a base charging current below a first temperature and otherwise a function of the base charging current and the compensation current.

One object of the present invention is to provide a temperature dependent current generating circuit.

Another object of the present invention is to provide such a circuit that is useful for charging a capacitor forming part of an automotive ignition system.

Yet another object of the present invention is to provide such a circuit operable to produce a temperature dependent current that compensates for temperature dependent behavior of the capacitor.

These and other objects of the present invention will become more apparent from the following description of the preferred embodiment.

BRIEF DESCRIPTION OF THE DRAWINGS

The present invention will now be described, by way of example, with reference to the accompanying drawings, in which.

DESCRIPTION OF THE PREFERRED EMBODIMENT

Figure 1:
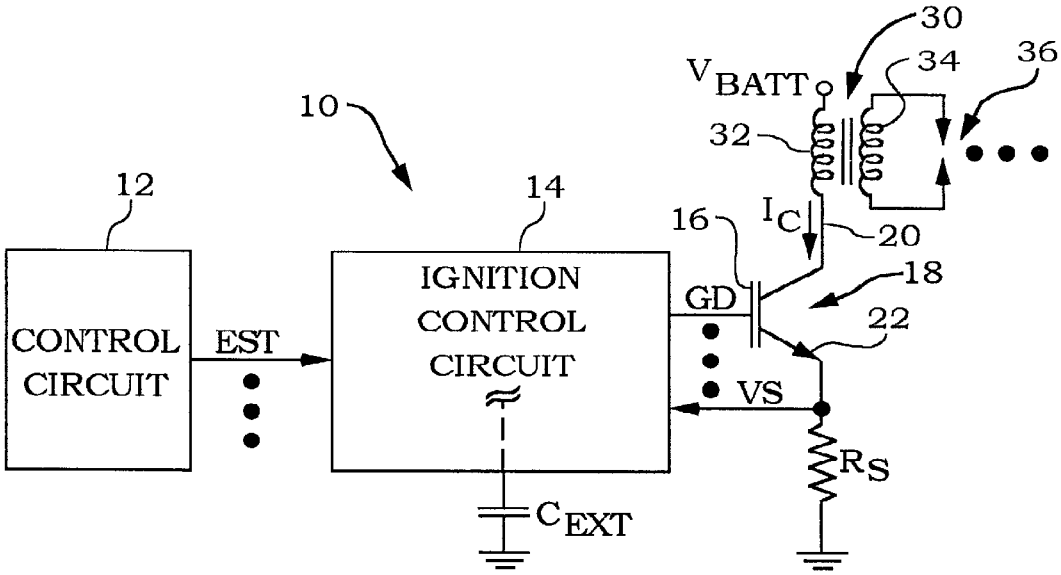
FIG. 1 (PRIOR ART)
FIG. 1 is a diagrammatic illustration of a prior art automotive ignition control system.
Figure 2:
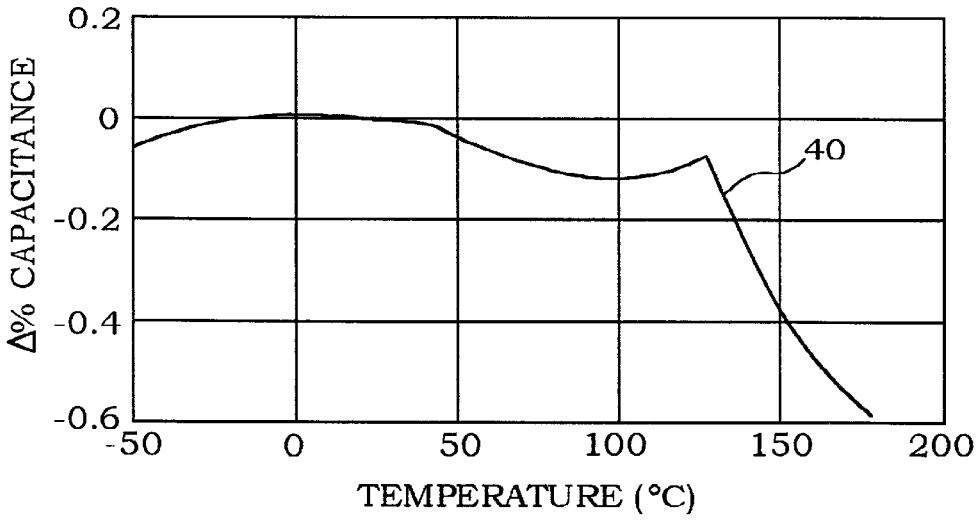
FIG. 2 (PRIOR ART)
FIG. 2 is a plot of capacitance change over temperature for a known capacitor used as capacitor CEXT in the circuit of FIG. 1.
Figure 3:
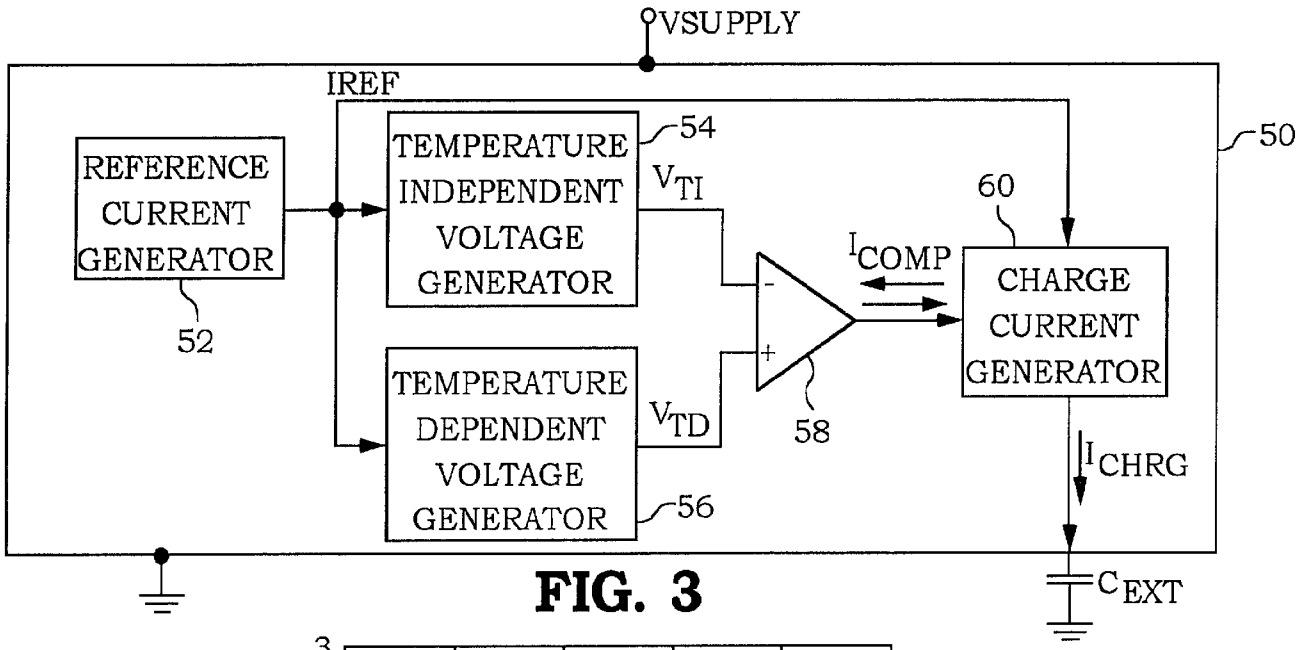
FIG. 3 is a block diagram illustration of one preferred embodiment of a temperature dependent current generating circuit useful for charging the capacitor CEXT of FIG. 1, in accordance with the present invention.

Referring now to FIG. 3, one preferred embodiment of a temperature dependent current generating circuit 50 useful for charging capacitor CEXT of the system of FIG. 1, in accordance with the present invention, is shown. Circuit 50 includes a reference current generator 52 establishing a reference current IREF and supplying this current to a temperature independent voltage generator 54, a temperature dependent voltage generator 56 and a charge current generator 60. Temperature independent voltage generator 54 is responsive to the reference current IREF to produce a temperature independent voltage VTI, and supply this voltage to an inverting input of a comparator circuit 58. Temperature dependent voltage generator 56 is likewise responsive to the reference current IREF to produce a temperature dependent voltage VTD, and supply this voltage to the non-inverting input of comparator circuit 58. An output of comparator circuit 58 is connected to a charge current generator circuit 60 and is operable to supply a current ICOMP thereto, and/or to draw the current ICOMP therefrom, as will be described in greater detail hereinafter. The charge current generator circuit 60 is responsive to the reference current IREF and the compensation current ICOMP produced by comparator circuit 58 to produce a charge current ICHRG for charging an external capacitor CEXT, wherein CEXT is, in one embodiment, of the type illustrated in FIG. 1 having capacitance versus temperature characteristics as illustrated in FIG. 2.

In one preferred embodiment, the temperature dependent current generating circuit 50 of the present invention develops capacitor charging currents ICHRG with different temperature characteristics for the two regions of capacitor operation shown in FIG. 2. For temperatures below approximately 125° C., a normal "bowed" temperature characteristic dominates. For temperatures above 125° C., a charging current with a much steeper decrease of temperature is produced. The different regions of operation are established by developing a high temperature cut-in point at which the temperature dependency of the charging current ICHRG is shifted from one mode to the other. For temperatures below the cut-in point, the charging current is relatively temperature flat, whereas for temperatures above the cut-in point, the charging current ICHRG is reduced at the same rate that the capacitance of CEXT reduces with temperature. This reduction of charging current ICHRG with temperature is achieved by subtracting a current with a first established temperature dependency from a current with a second established temperature dependency. The degree of this subtraction is temperature dependent, such that the final charge current ICHRG produces a somewhat linear charging current versus temperature characteristic.

Figure 5:
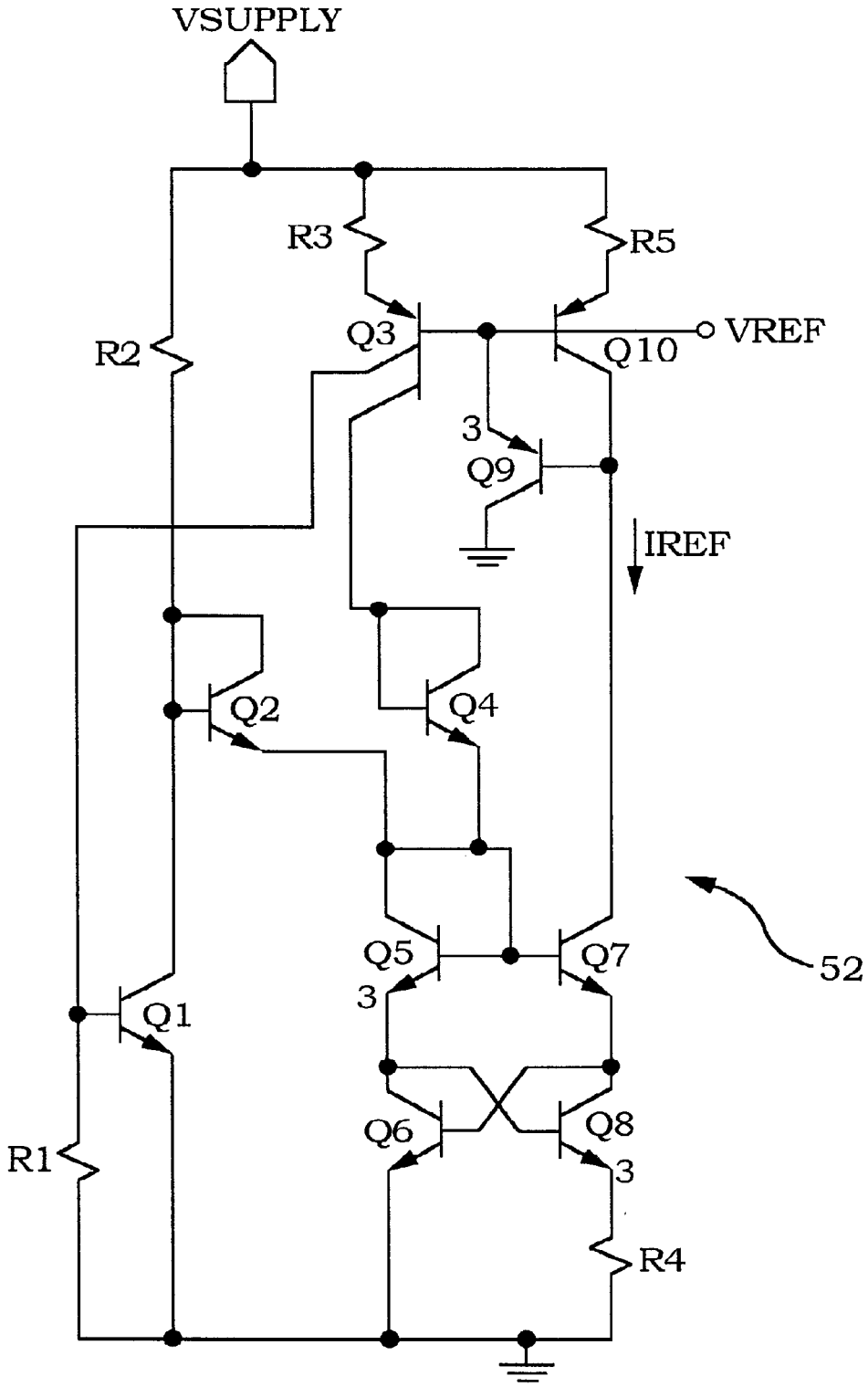
FIG. 5 (PRIOR ART)
FIG. 5 is a device-level schematic of a known reference current generating circuit used to establish a reference current.

The high temperature current characteristic cut-in point is developed by comparing the substantially temperature independent reference voltage VTI produced by circuit 54 with the temperature dependent voltage VTD produced by circuit 56 . The temperature dependent voltage VTD is developed by impressing a "delta-Vbe" current IREF on a standard silicon diffused resistor which has a substantial positive temperature coefficient, wherein the "delta-Vbe" current IREF is preferably a standard building block current familiar to those skilled in the art. Referring to FIG. 5, one preferred embodiment of the reference current generating circuit 52 for establishing IREF is shown, wherein circuit 52 is a known and widely used circuit for generating currents. This reference current, IREF, has a slight positive temperature coefficient, and is defined by the equation IREF=[Vt *ln (N)]/R4, wherein Vt is the thermal voltage defined by the equation Vt=(k *T)/ q. In this expression, "k" is Boltzman's constant, "T" is temperature (in degrees Kelvin), and "q" is the electronic charge. "N" is a constant and is defined by the ratio of emitter areas of NPN transistors Q5–Q8, and R4 is the resistance chosen to establish the magnitude of the current IREF.

Those skilled in the art will recognize that in any device-level circuitry illustrated and described herein, transistors shown having an integer associated with its emitter will be understood to define an emitter area that is larger than a "standard" emitter area by the indicated integer number. Similarly, any transistor shown not having an integer associated with its emitter will be understood to define a "standard" emitter area. In the circuitry of FIG. 5, for example, the emitter areas of transistors Q5 and Q8 combine to form the constant "N" wherein "N" is, in this embodiment, equal to 9. The reference current IREF establishes a bias voltage VREF at the node labeled VREF, wherein this bias voltage VREF is used to generate scaled versions of the reference current IREF in circuits 54–60 as is known in the art. In general, the temperature coefficient of the current IREF generated by circuit 52 of FIG. 5 is slightly positive with increasing temperature, but flattens out to a substantially constant current at high temperatures.

Figure 6:
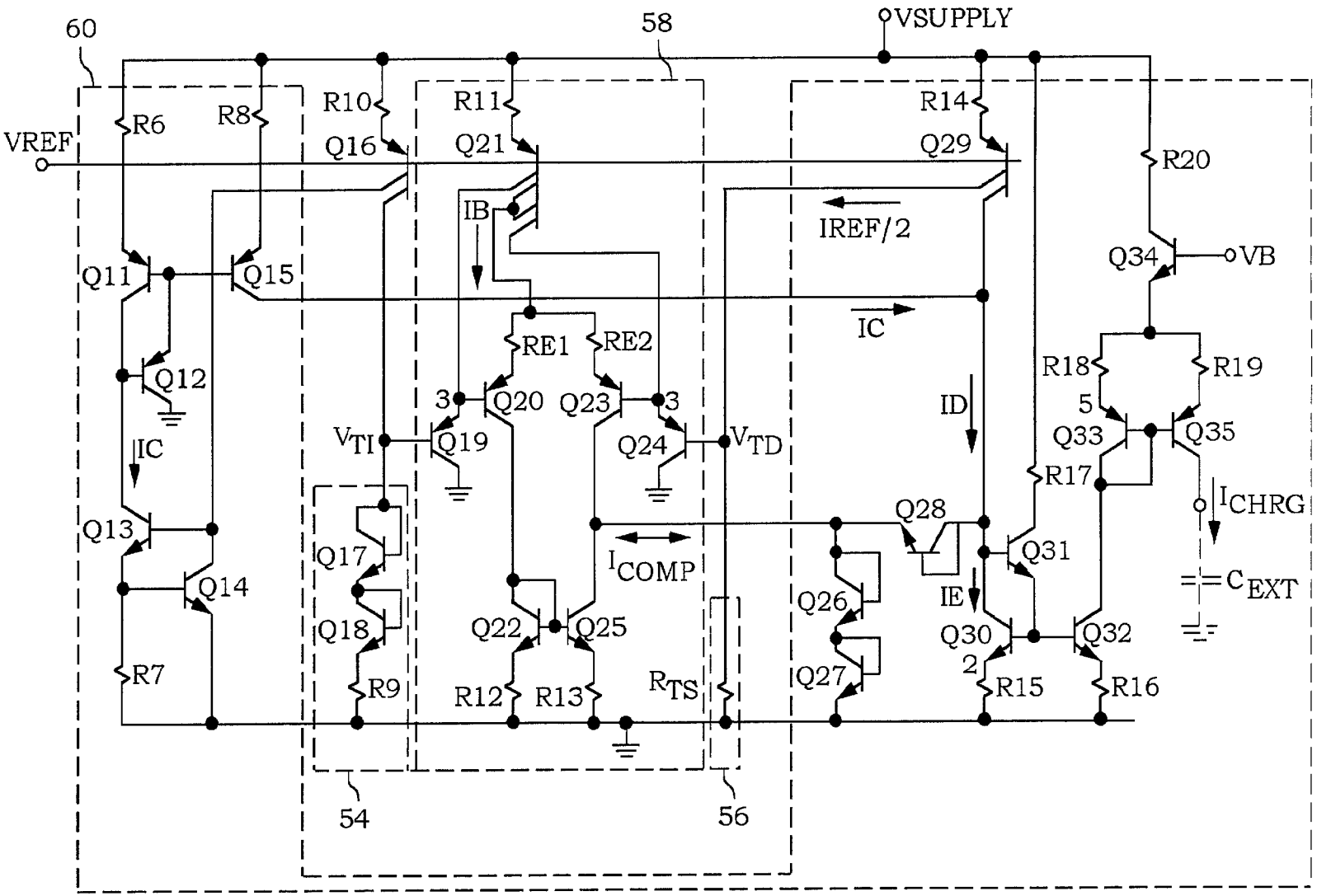
FIG. 6 is a device-level schematic illustrating one preferred embodiment of the temperature dependent current generating circuit of FIG. 3 that also makes use of the reference current generating circuit of FIG. 5.

The substantially temperature independent reference voltage VTI is preferably developed by forcing the current IREF through a series combination of one or more diodes and a carefully selected integrated silicon diffused resistor. Silicon diffused resistors typically have positive temperature coefficients while the integrated diode forward voltage drops have a negative temperature coefficient. By combining the diode forward voltages with the voltage developed across the silicon diffused resistor with the current IREF, a voltage that is some integral multiple of the silicon bandgap voltage (i.e., approximately 1.26 volts) is developed. Referring to FIG. 6, one preferred embodiment of a two-diode configuration for generating the voltage VTI is shown outlined by dashed-line bock 54. In this embodiment, voltage VTI is established by forcing the current IREF/2, produced by a half collector of transistor Q16, onto the series combination of diode configured transistors Q17 and Q18 and silicon diffused resistor R9. By forcing IREF/2 through diodes Q17 and Q18 and R9 sized appropriately, VTI has a temperature characteristic that is substantially temperature independent for the operating temperature range of interest.

Figure 4:
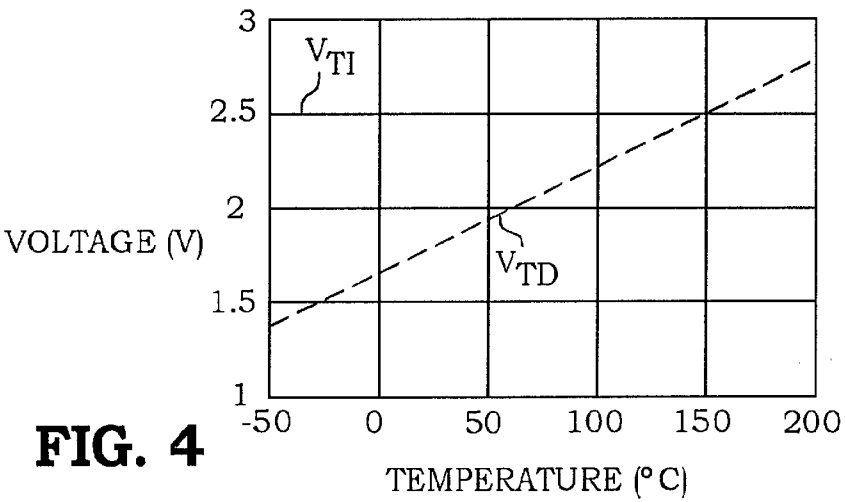
FIG. 4 is a plot of voltage vs. temperature illustrating operation of some of the circuitry of FIG. 3.

The temperature independent voltage VTI thus generated can be used as a reference voltage for comparison with a temperature dependent voltage VTD in order to establish the cut-in temperature at which the change in temperature dependencies of a capacitor charging current (i.e., ICHRG) are altered. In one embodiment this temperature dependent voltage VTD is developed by forcing a copy of the current IREF onto a silicon diffused resistor as shown outlined by dashed-line block 56 in FIG. 6. The resulting temperature dependent voltage VTD is described by the equation VTD =[Vt *ln(9)]*(RTS/R4), wherein R4 is the resistor of circuit 52 used to establish the magnitude of IREF, and RTS is a resistor used to sense the operating temperature. If RTS and R4 are formed from the same silicon diffused resistor process, their process variations and temperature characteristics cancel in this ratio. Circuit 50 of the present invention is therefore preferably formed as a single integrated circuit fabricated in accordance with a known silicon fabrication process. This leaves two constants, RTS/R4 and the natural logarithm of 9, as multipliers of the temperature characteristic of the thermal voltage Vt. In accordance with one preferred integrated circuit fabrication process, Vt is approximately 86 microvolts per degree C, and the voltage VTD thus increases linearly with increasing temperature. The values of R4 and RTS are preferably chosen such that the voltage VTD is of a magnitude compatible with for comparison with the bandgap reference voltage VTI described above. Referring to FIG. 4, the temperature relationship of the bandgap reference voltage VTI and the temperature dependent voltage VTD for one set of preferred resistor values is shown. As can be seen from FIG. 4, VTD increases linearly with temperature until it becomes equal to VTI in the temperature range in which the capacitance of CEXT falls off with temperature (compare with FIG. 2). The two voltages VTI and VTD may then be compared via comparator circuit 58 to produce an output current ICOMP from which the capacitor charging current ICHRG may be generated.

To avoid a step function in the charging current ICHRG at the high temperature cut-in point, it is desirable to "linearize" the comparator circuitry 58 such that the charging current ICHRG can be gradually modified over wider ranges of temperature. One preferred embodiment of comparator circuit 58 is shown outlined by dashed-line block 58 in FIG. 6, wherein the addition of resistors RE1 and RE2 in the emitters of PNP transistors Q20 and Q23 act to reduce the gain of comparator circuit 58 and thereby cause the output of comparator circuit 58 to switch over a wider range of temperatures. The values of RE1 and RE2 are, in part, chosen to set this wider range of operation to match the range of temperature over which the circuitry is intended to track the varying capacities of capacitor CEXT. When the voltage VTD a the non-inverting input of comparator circuit 58 is higher than the voltage VTI at the inverting input, the output current ICOMP becomes negative (with positive current being defined as current sourced out of the comparator circuit 58 and negative current being defined as current sunk into the comparator circuit 58). In the fully tipped biased condition wherein VTD is much greater than VTI, the comparator circuit 58 sinks a current ICOMP equal to the bias current IB produced by two of the ¼ collectors of Q21. It is this bias current IB that is ultimately subtracted from the current used to define the capacitor charging current ICHRG, and it is therefore necessary to consider the temperature coefficient of this bias current IB and the temperature coefficient of the current from which it is being subtracted, since these temperature coefficients will ultimately affect the temperature response of the final capacitor charging current ICHRG.

Up to this point, a system has been described which can detect a temperature set point or cut-in point and, for some region around that set point, modify a charging current ICHRG in a linearized fashion around the set point. The reduction in capacitance as temperature increases does not, however, have a characteristic that matches the linearized behavior of the comparator output for temperatures above the set point. It is therefore necessary to create a current with a temperature dependency that will work in tandem with the comparator output to track the capacitance temperature characteristics. Since the capacitance continues to fall with increasing temperature, a charging current with a negative temperature coefficient is required at temperatures substantially above the set point or cut-in point temperature. The linearized current switching produced by the comparator circuit 58 will allow a smooth transition from a charging current ICHRG with a relatively flat temperature characteristic to one that is increasingly negative as temperature increases. Additionally, as can be seen in FIG. 2, the capacitance of CEXT has a smaller, but non-negligible, negative temperature coefficient from approximately 0° C. to the breakover point at approximately 125° C. In order to track this slope, the overall charging current ICHRG needs to have a negative temperature coefficient in this same temperature range.

In one preferred embodiment, this negative temperature coefficient current is created by charge current generator circuit 60, as shown in FIG. 6 as surrounded by dashed-line block 60, by imposing a voltage with a negative temperature coefficient across a silicon diffused resistor R7 having a positive temperature coefficient. The resulting current IC through the resistor R7 will have a substantial negative dependence upon temperature, wherein IC can be scaled and combined with a positive temperature coefficient current (a "delta-Vbe" current IREF, for example) to produce a current ID that is temperature independent. This current ID can then be used to charge capacitor CEXT at temperatures below the point where the capacitance begins to fall off rapidly. If the comparator current ICOMP is then subtracted from the current ID for temperatures above the set point or high temperature cut-in point, the resulting charging current ICHRG will have a negative temperature coefficient. Matching the specific temperature dependency of the current ID-ICOMP, combined with the switching characteristics of comparator circuit 58, to the temperature characteristics of the capacitor CEXT is within the knowledge of a skilled artisan.

Transistors Q19–Q25 and resistors RE1, RE2, R12 and R13 comprise the linearized comparator circuit 58 described hereinabove. The temperature independent reference voltage VTI is supplied to the inverting input defined by the base of Q19, and the temperature dependent voltage VTD is supplied to the non-inverting input defined by the base of Q24. A current IB that is a scaled version of IREF biases the comparator circuit 58 via two of the collectors of transistor Q21, and resistor R11 determines the ratio of Q21's emitter current to the current IREF. While the calculations necessary to set up this current IB is within the knowledge of a skilled artisan, it is to be understood that the magnitude of this current is critical since it is the current that will, in the fully tipped comparator state, be subtracted from the current ID.

The negative temperature characteristic current IC is developed by the combination of R7 and Q14, such that when biased by IREF/2, Q14's base-emitter voltage is impressed across resistor R7 thereby determining the current IC therethrough. IC is mirrored by transistors Q11 and Q15 and is combined with a current IREF/2, as generated by the other half collector of Q29, to form the composite current ID. At temperatures below the high temperature cut-in point, the current ID is forced onto transistor Q30. Q30 and Q32, along resistors R15 and R16, form a current mirror which scales and mirrors this current to transistor Q33. This current is again scaled and mirrored by transistors Q33 and Q35, along with resistors R18 and R19, such that the resulting current sourced by transistor Q35's collector is the charge current ICHRG used for charging capacitor CEXT. The current mirror scale factors at Q30, Q32, Q33 and Q35 are determined based upon the charging current magnitude requirements, wherein such calculations are well within the knowledge of a skilled artisan. The base of transistor Q34 is connected to a bias voltage VB which preferably does not vary with overall supply voltage VSUPPLY. By biasing Q34 in this fashion, supply dependencies introduced by Early Voltage effects on transistors Q32, Q33 and Q35 are eliminated. Bias voltage VB may be generated by any number of known sources or circuits, but must be of magnitude high enough to prevent transistors Q32 and Q35 from saturating under all expected operating conditions.

At temperatures well below the high temperature cut-in point, the comparator circuit 58 is biased in a condition such that it is sourcing the current ICOMP out to transistors Q26 and Q27. Q26 and Q27 are configured as base-emitter diodes and are operable to limit the voltage at the collector of Q25, thereby preventing saturation of Q23. Transistor Q28, also configured as a base-emitter diode, prevents the current ICOMP sourced by the comparator circuit 58 from being added to the current ID discussed above. As the system temperature approaches the high temperature cut-in point, transistors Q20 and Q23 become biased such that Q20 begins conducting current, wherein this current is mirrored by transistors Q22. Once the set point is reached and the voltage VTD equals the voltage VTI, Q25 is operable to sink a current equal to that source by Q23. At this point, the comparator output current ICOMP is 0. For temperatures above the set point, Q25 is operable to sink more current than Q23 sources, and ICOMP becomes negative; i.e., the comparator circuit 58 is operable to sink the current ICOMP. This current ICOMP can only come from current ID such that the current IE is equal to the current ID minus the current ICOMP. This reduction in current ID is effectively the subtraction of a fraction of the current IREF from the charging current ICHRG. By subtracting such a fraction of IREF, not only is the final capacitor charging current ICHRG magnitude reduced, but the charging current ICHRG takes on a more negative temperature coefficient since some of the positive temperature coefficient component has been removed through the subtraction.

As the system temperature increases beyond the set point, the comparator bias changes causing current ICOMP to increase, thereby continuing to reduce the current IE and, in turn, the final output current ICHRG. The rate at which ICOMP changes with temperature is a function of the values chosen for resistors RE1 and RE2, and of the changing temperature coefficient of the current ID. The calculations of the values of RE1, RE2, the scaling of the bias current IB, and the mixing of current IC with IREF/2 to form the composite current ID, must all be performed with respect to each other to create the final desired response of ICHRG with temperature, wherein such calculations are within the knowledge of a skilled artisan.

Eventually, at temperatures well above the set point, the full magnitude of bias current IB is subtracted from current ID to form the current IE. For temperatures above this point, there is accordingly no further modification of the charge current ICHRG. This provides a failsafe over-temperature protection by causing the over-dwell timeout time to reduce as temperature increases further and as the capacitance of CEXT continues to decrease. Eventually, the total allowed dwell time will be reduced to a point where the thermal generation in the system due to power dissipation in the coil, coil switching electronics, and current sense elements is reduced to a level that will stabilize the temperature in the system.

While the temperature dependent current generating circuit 50 of the present invention may be used to develop a temperature dependent charge current ICHRG for any desired application, circuitry 50 is, in one embodiment, created in silicon integrated circuit form and combined with the timing circuitry described in U.S. Pat. No. 5,819,713 which is assigned to the assignee of the present invention, and the contents of which are incorporated herein by reference. The circuitry of Pat. No. 5,819,713 performs the functions of an over-dwell protection timing circuit along with a "soft shutdown" of the ignition coil current in an automotive ignition system. In this application, the dwell timeout function requires charging of a timing capacitor with a known current, and the soft-shutdown function requires a controlled discharge of the same capacitor. By deriving both the charging and discharging currents in that system from the output of circuitry 50 of the present invention, the effects of temperature on the external capacitor CEXT, and therefore on the timing functions, may be minimized.

While the invention has been illustrated and described in detail in the foregoing drawings and description, the same is to be considered as illustrative and not restrictive in character, it being understood that only the preferred embodiment has been shown and described and that all changes and modifications that come within the spirit of the invention are desired to be protected.

What is claimed is:

1. A temperature dependent current generating circuit, comprising:

a first circuit producing a first voltage that is substantially constant over a range of temperatures;

a second circuit producing a second voltage as an increasing function of temperature over said range of temperatures;

a third current producing a charging current; and a comparator circuit responsive to said first and second voltages to draw a compensation current away from said charging current when said second voltage increases with temperature above said first voltage, said compensation current increasing with increasing temperature over said range of temperatures.

2. The circuit of claim 1 where said first circuit includes a bandgap voltage generating circuit producing a bandgap voltage, said first voltage a multiple of said bandgap voltage.

3. The circuit of claim 2 wherein said first and second circuits are configured such that said second voltage is less than said first voltage for temperatures below a first temperature and is greater than said first voltage for temperatures above said first temperature.

4. The circuit of claim 3 wherein said third circuit is configured to produce said charging current as a base charging current for temperatures below said first temperature and as said base charging current less said compensation current for temperatures above said first temperature.

5. The circuit of claim 4 further including a capacitor forming part of an ignition control circuit, said capacitor receiving said charging current from said third circuit.

6. The circuit of claim 4 wherein said comparator circuit is configured to source said compensation current for temperatures below said first temperature and to sink said compensation current for temperatures above said fist temperature;

and wherein said third circuit is configured to allow said compensation current to be drawn away from said base charging current for temperatures above said first temperature, and to inhibit influence of said compensation current on said base charging current for temperatures below said first temperature.

7. The circuit of claim 1 wherein said comparator circuit is configured to source said compensation current when said second voltage is below said first voltage and to sink said compensation current when said second voltage is above said first voltage;

and wherein said third circuit is configured to allow said compensation current to be drawn away from said charging current when said comparator circuit is sinking said compensation current, and to inhibit influence of said compensation current on said charging current when said comparator circuit is sourcing said compensation current.

8. The circuit of claim 7 wherein said first circuit includes a bandgap voltage generating circuit producing a bandgap voltage, said first voltage a multiple of said bandgap voltage.

9. The circuit of claim 1 further including a capacitor forming part of an ignition control circuit, said capacitor receiving said charging current from said third circuit.

10. A temperature dependent current generating circuit, comprising:

a first circuit producing a compensation current as a function of temperature; and a second circuit producing a charging current as a base charging current below a first temperature and otherwise a function of said base charging current and said compensation current.

11. The circuit of claim 10 wherein said first circuit includes means for producing a first voltage, said first voltage substantially constant over temperature.

12. The circuit of claim 11 wherein said first circuit includes means for producing a second voltage, said second voltage increasing with increasing temperature.

13. The circuit of claim 12 wherein said first circuit is configured such that said first voltage is equal to said second voltage at said first temperature.

14. The circuit of claim 13 wherein said first circuit includes a comparator receiving said first and second voltages and producing said compensation current as a function thereof.

15. The circuit of claim 14 wherein said comparator is configured to source said compensation current at temperatures below said first temperature and to sink said compensation current at temperatures above said first temperature, said compensation current increasing with increasing temperature above said first temperature.

16. The circuit of claim 15 wherein said second circuit includes:

means for inhibiting influence of said compensation current on said base charging current at temperatures below said first temperature; and means for allowing said compensation current to be drawn away from said base charging current at temperatures above said first temperature.

17. The circuit of claim 16 further including a capacitor forming part of an ignition control circuit, said capacitor receiving said charging current from said third circuit.

18. The circuit of claim 11 wherein said first circuit includes a bandgap voltage generating circuit producing a bandgap voltage, said first voltage a multiple of said bandgap voltage.

19. The circuit of claim 10 further including a capacitor forming part of an ignition control circuit, said capacitor receiving said charging current from said third circuit.

20. The circuit of claim 10 wherein said first temperature corresponds to approximately 125 degrees C.

* * * * *